United States Patent [19]

Smiley

[11] 4,324,952

[45] Apr. 13, 1982

[54] DIRECT FUNCTION RECEIVERS AND TRANSMITTERS FOR MULTICHANNEL COMMUNICATIONS SYSTEM

[75] Inventor: Charles F. Smiley, Quincy, Ill.

[73] Assignee: Harris Corporation, Cleveland, Ohio

[21] Appl. No.: 163,396

[22] Filed: Jun. 26, 1980

Related U.S. Application Data

[63] Continuation of Ser. No. 935,142, Aug. 21, 1978, abandoned.

[51] Int. Cl.[3] ..... H04H 5/00

[52] U.S. Cl. ..... 179/1 GS; 329/135; 329/147; 332/17

[58] Field of Search ..... 179/1 GS; 329/135, 147, 329/167; 332/17, 23 A, 21, 22, 40, 41

[56] References Cited

U.S. PATENT DOCUMENTS

| | | | |
|---|---|---|---|
| 3,059,056 | 10/1962 | Freedman et al. | 179/1 GS |
| 3,068,475 | 12/1962 | Avins | 179/1 GS |
| 3,148,342 | 9/1964 | Holt | 179/1 GS |
| 3,218,393 | 11/1965 | Kahn | 179/1 GS |
| 3,908,090 | 9/1975 | Kahn | 179/1 GS |
| 4,079,204 | 3/1978 | Takahashi et al. | 179/1 GS |
| 4,172,966 | 10/1979 | Parker et al. | 179/1 GS |

*Primary Examiner*—Douglas W. Olms
*Attorney, Agent, or Firm*—Yount & Tarolli

[57] ABSTRACT

Transmitters and receivers are disclosed for communicating composite modulated signals including at least two modulated components. The transmitters include phase and envelope operators (54, 56) which generate the phase and envelope portions of the composite modulated signals separately by directly implementing the mathematical equations defining them. The phase operator (54) derives the phase portion as an audio frequency signal, and a phase modulator (58) responds to this phase signal to modulate the phase of an RF carrier signal in accordance therewith. The receivers include circuits (230, 232) for separately detecting the envelope and phase portions of the composite modulated signal. The phase signal is directed through a trigonometric operator such as a cosine (234), sine (236), or tangent (258) operator, and the output of this operator is multiplied by the envelope signal in an analog multiplier (238, 240) to recover a selected component of the modulated signal. The signals modulated onto the composite modulated signal are therefore asynchronously recovered so that carrier recovery circuitry such as is utilized in conventional synchronous detectors is no longer necessary.

22 Claims, 15 Drawing Figures

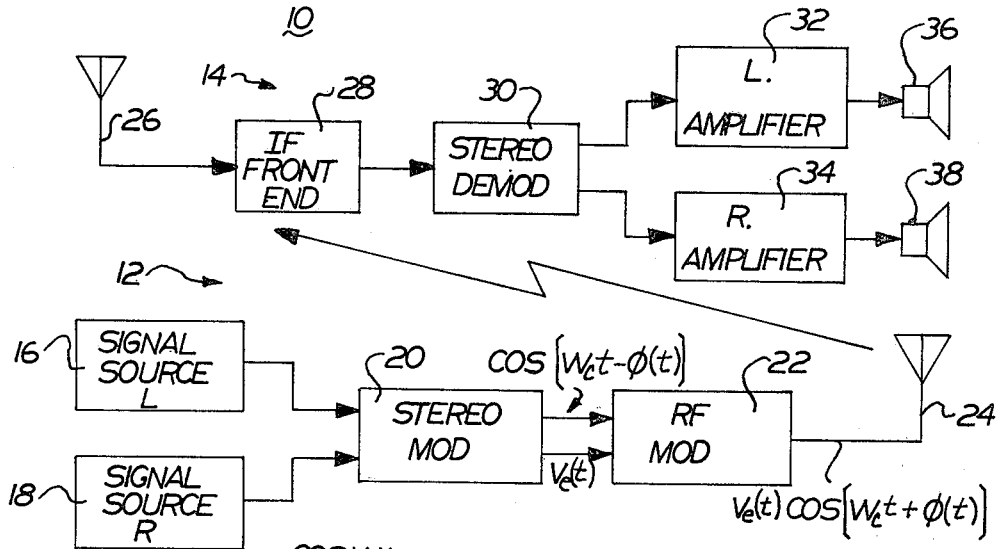
FIG. 1
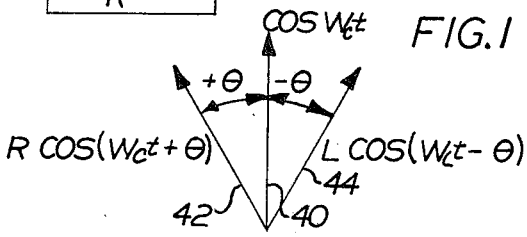
FIG. 2A
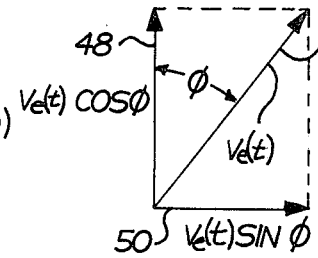
FIG. 2B
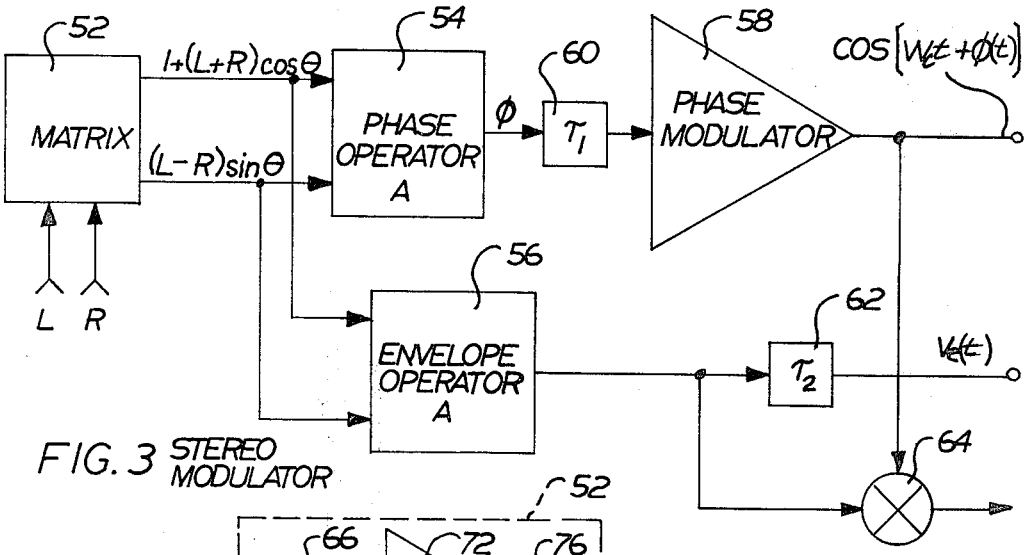
FIG. 3 STEREO MODULATOR
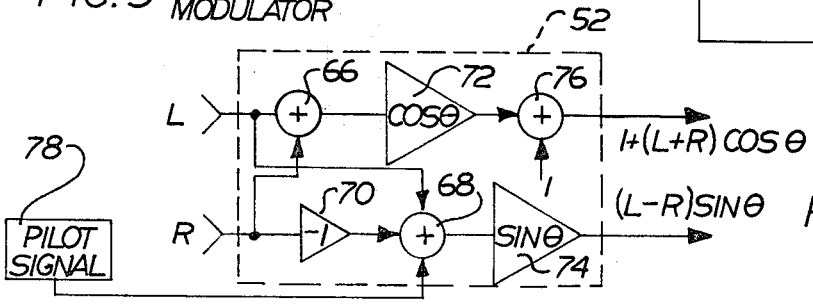
FIG. 4 MATRIX

PHASE MOD.
58

ENVELOPE OPERATOR B
130

DIRECT FUNCTION RECEIVERS AND TRANSMITTERS FOR MULTICHANNEL COMMUNICATIONS SYSTEM

This is a continuation, of application Ser. No. 935,142 filed Aug. 21, 1978, now abandoned.

CROSS REFERENCE TO RELATED APPLICATIONS

Related commonly assigned, co-pending applications include Leitch "Compatible AM Stereo Systems Employing a Modified Quadrature Modulation Scheme", Ser. No. 019,837, filed Mar. 12, 1979 now U.S. Pat. No. 4,236,042, continuation of Ser. No. 812,657, now abandoned; Leitch "AM Stereo Receivers", Ser. No. 829,518, filed Aug. 31, 1977 now U.S. Pat. No. 4,232,189; and Hershberger "Asynchronous Multichannel Receiver," Ser. No. 934,811, filed Aug. 18, 1978.

BACKGROUND AND FIELD OF THE INVENTION

The present invention relates to multichannel communications systems, and more particularly to multichannel communications systems where the modulation and demodulation of the signals to be communicated is accomplished by direct implementation of the mathematical equations characterizing those signals.

Many systems have been proposed for transmitting and receiving stereophonic signals in the AM frequency band. Several of these schemes have proposed amplitude modulating the two program signals onto differently phased carriers. These differently phased carriers are linearly combined to form the composite modulated signal which is to be transmitted. Some of the proposed systems have set the phase angle between the two carrier signals at approximately 90°, thus providing a standard quadrature modulating scheme. Other systems have been proposed where the phase angle between the two carriers is reduced to less than 90°. A system of this latter sort is described in the co-pending patent application of Leitch, U.S. Ser. No. 812,657, filed July 5, 1977.

The systems which have been devised to generate and transmit these composite modulated signals have generally utilized conventional AM modulation techniques. Thus, in these systems each of the program signals is modulated onto a separate carrier signal, and the carrier signals are then added together to create the composite modulated signal. In order to transmit this signal with a standard AM transmitter, this composite modulated signal is separated into phase and amplitude portions. More specifically, the composite modulated signal is hard-limited to provide a constant amplitude, phase modulated RF signal. This RF signal is directed to the RF input of the AM transmitter. The composite modulated signal is also envelope detected to provide an audio frequency signal having an amplitude defining the envelope of the composite modulated signal. This audio signal is directed to the audio input of the conventional AM transmitter. The transmitter amplifies the RF and audio signals and then recombines them to form a high-level composite modulated signal for transmission. These previous modulators therefore utilize three separate steps: modulation to form a low level composite modulated signal; demodulation to separate the composite modulated signal into audio and RF portions; and modulation to form a high level composite modulated signal for transmission.

One problem encountered in the implementation of these systems resides in the inequality of the time delays in the audio and RF channels of a conventional AM transmitter. It is possible for the time delay of the signals in the audio (envelope) channel to be much larger than the time delay in the RF (phase) channel. In this event, it would be necessary to insert an appropriate delay in the RF channel, so that the phase and amplitude information of the signal transmitted by the transmitter were appropriately synchronized. Implementation of the required radio frequency delays, however, is not easily accomplished.

The receivers which have been proposed for receiving signals modulated in this fashion generally utilize conventional synchronous demodulation methods. In these receivers, a phase-locked-loop is generally used to recover the carrier component of the modulated signal, with this carrier component then being utilized in conjunction with product detectors to synchronously recover the program signals from the composite modulated signal.

SUMMARY OF THE INVENTION

The systems disclosed herein accomplish the modulation and demodulation functions by directly implementing the equations describing the envelope and phase characteristics of the composite modulated signal. Thus, in the transmitter, the envelope signal is derived by directly implementing the equation defining the envelope of a composite modulated signal, and a phase signal is derived by directly implementing the equation defining the phase of the modulated signal. The phase signal, which is an audio frequency signal, is directed to a phase modulator which modulates the phase of an RF carrier signal in accordance therewith. As has been the case in the past, the modulated RF signal is directed to the RF input of a conventional AM transmitter, whereas the envelope signal is directed to the audio input.

This system therefore directly derives the phase and envelope information, without the necessity of first forming a low level composite modulated signal, and then separating it into RF and audio portions. The distortion accompanying the multiple conversions of previous designs is thus avoided.

An additional advantage of this system resides in the fact that the phase signal is derived as a separate, non-RF signal. Any necessary delay in the RF channel may therefore be accomplished by inserting an audio frequency delay in the path of the phase signal. It is therefore possible to delay the phase and envelope signals by any relative amount, without utilizing RF delay techniques.

The receivers disclosed herein similarly operate to directly demodulate the composite modulated signal by implementing the equations defining the phase and amplitude characteristics thereof. These schemes do not require the inclusion of carrier recovery loops, and therefore avoid the cost and added complexity associated therewith.

It is therefore an object of the present invention to provide a modulator for providing a composite modulated signal where the modulator directly derives phase and amplitude signals having values indicative of the phase and amplitude of the composite modulated signal.

It is a further object of the present invention to provide a modulation scheme wherein relative delays between the phase and amplitude portions of a composite modulated signal may be easily implemented.

It is yet another object of the present invention to provide a modulation system wherein a phase signal is derived having an amplitude indicative of the phase of the composite modulated signal, and a phase modulator is provided for modulating the phase of an RF carrier signal in accordance with this phase signal.

It is another object of the present invention to provide a demodulation system for asynchronously demodulating a modulated signal.

It is yet another object of the present invention to provide a demodulator which does not require a carrier recovery loop or its associated circuitry.

It is still another object of the present invention to provide a demodulator which directly recovers the signals modulated upon a composite modulated signal by implementing the mathematical functions defining them.

It is still another object of the present invention to derive the in-phase and quadrature-phase components of a composite modulated signal by multiplying the envelope of the composite modulated signal by a signal which is trigonometrically related to the phase of the composite modulated signal.

In accordance with the present invention, apparatus is provided for generating a composite modulated signal including a carrier component and two phase components which are phased on either side of the carrier component, each of the phase components being modulated by a corresponding source signal. This apparatus includes means for providing the first and second source signals, and means responsive to the first and second source signals for directly deriving an envelope signal indicative of the manner in which the envelope of the composite signal is to vary, and for directly deriving a phase signal indicative of the manner in which the phase of the composite modulated signal is to vary. Means are provided responsive to the phase signal for providing a carrier signal whose phase varies in accordance with the phase signal. Modulator means modulates the amplitude of the carrier signal in accordance with the envelope signal and so to thereby provide the composite modulated signal.

In accordance with another aspect of the present invention, apparatus is provided for deriving an RF signal whose phase is modulated in accordance with the phase of the vector sum of first and second vector components. This apparatus includes first means for providing first and second signals which respectively define the amplitudes of the first and second vector components, and second means responsive to the first and second signals for providing third and fourth signals, each of which defines the amplitude of a corresponding one of two orthogonal vectors, the vector sum of which is the same as the sum of the first and second vector components. Third means is provided responsive to the third and fourth signals for deriving a phase signal indicative of the phase angle between the vector sum and one of the third and fourth signals. Phase modulator means is also provided for modulating the phase of an RF signal in accordance with the phase signal.

In accordance with yet another aspect of the present invention, apparatus is provided for asynchronously demodulating a modulated signal which has at least two phase components. An envelope detector responds to the modulated signal to provide an envelope signal corresponding generally to the envelope of the modulated signal, and a phase detector responds to the modulated signal to provide a phase signal corresponding generally to the phase of the modulated signal. Trigonometric operator means responds to the phase signal for providing an output signal which is related to the phase signal in accordance with a selected trigonometric relationship. Multiplier means multiplies the output signal by the envelope signal so as to thereby provide a demodulated output signal corresponding generally to the selected component of the modulated signal.

BRIEF DESCRIPTION OF THE DRAWINGS

The foregoing and other objects and advantages of the present invention will become more readily apparent from the following detailed description, as taken in conjunction with the accompanying drawings, wherein:

FIG. 1 is a block diagram of an AM stereo system in which the present invention may conveniently find use;

FIGS. 2A and 2B are vector diagrams useful in understanding the relationship between the various components of the composite modulated signal;

FIG. 3 is a block diagram of a stereo modulator in accordance with the teachings of the present invention;

FIG. 4 is a more detailed illustration of the matrix block of the stereo modulator of FIG. 3;

DETAILED DESCRIPTION OF THE DRAWINGS

Figure 5:
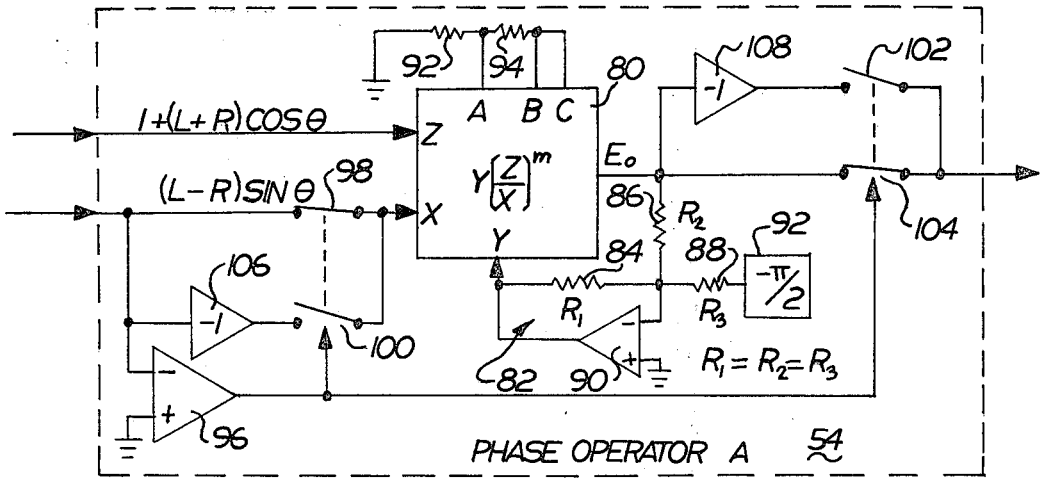
FIG. 5 is a more detailed illustration of the phase operator block of the stereo modulator of FIG. 3.

There is illustrated in FIG. 1 a block diagram of a conventional stereo receiver-transmitter system, in which the present invention could conveniently find use. This system 10 includes a transmitter station 12 and a receiver station 14.

The transmitter station 12 includes signal sources 16 and 18 for providing two source signals which are to be transmitted to the receiver station 14. In accordance with accepted terminology, the audio signals provided by these two signal sources will hereinafter be referred to as left (L) and right (R) source signals. These two signals are directed to a stereo modulator 20 which generates a composite modulated signal, separated into phase, and envelope portions. The phase portion Cos $(W_c t - \phi(t))$, comprises an RF signal having a modulated phase, whereas the envelope signal $V_e(t)$ comprises an audio frequency signal. An RF modulator 22, which may be a conventional AM transmitter, modulates the RF signal in accordance with the envelope function so as to provide a high level composite modulated signal. This signal is transmitted via an antenna 24 to the receiving station 14.

The receiving station 14 receives the transmitted signal via a receiving antenna 26 and supplies it to an IF front-end 28. This IF front-end converts the received RF signal to an intermediate, or IF frequency. Stereo demodulator 30 responds to the IF signal to derive the left and right source signals therefrom. The left and right signals, thus recovered, are amplified via respective amplifiers 32 and 34 and are then provided to any desired utilization means, illustrated in the Figure as comprising speakers 36 and 38.

In much (but not all) of the discussion which follows, the composite modulated signal which is transmitted by transmitting station 12 and received by receiving station 14 will have the form graphically depicted in FIGS. 2A and 2B. As can be seen in FIG. 2A, this composite modulated signal may be characterized as essentially a linear combination of three differently-phased vector components. These three components include a fixed amplitude carrier component 40, and two modulated components 42 and 44 which are phased at fixed, equal angles on either side of the carrier component 40. Each of these phase components 42 and 44 is double-sideband, suppressed carrier (DSB-SC) modulated by a corresponding one of the source signals. The composite modulated signal $X_T$ may be characterized by the following mathematical expression:

$$X_T = \text{Cos}\, W_c t + L\,\text{Cos}(W_c t - \theta) + R\,\text{Cos}(W_c t + \theta) \quad (1)$$
$$= [1 + (L + R)\text{Cos}\theta]\text{Cos}\, W_c t + [(L - R)\text{Sin}\theta]\text{Sin}\, W_c t \quad (2)$$

The vector sum of the components 40, 42, and 44 will be a single sum vector 46, as shown in FIG. 2B. Although the vector components 40, 42, and 44 occupy fixed phase relationships with respect to one another, the phase of the vector sum 46 (as well as its amplitude) will vary, due to the varying contributions of the two vector components 42 and 44. The vector sum 46 may be characterized by the following mathematical expression:

$$X_T = V_e(t)\,\text{Cos}\,(W_c t - \phi(t)) \quad (3)$$

Where:

$$V_e(t) = \sqrt{[1 + (L+R)\,\text{Cos}\,\theta]^2 + [(L-R)\,\text{Sin}\,\theta]^2} \quad (4)$$

$$\phi(t) = \arctan \frac{(L - R)\text{Sin}\theta}{1 + (L + R)\text{Cos}\theta} \quad (5)$$

The vector sum 46 may be resolved into two orthogonal vector components 48 and 50. Vector component 48 is in-phase with the carrier component, whereas vector component 50 is in phase-quadrature therewith. From basic trigonometry, the amplitude of the in-phase components is $V_e(t)$ Cos $\phi$, whereas the amplitude of the quadrature-phase component is $V_e(t)$ Sin $\phi$. Thus, the composite modulated signal may equivalently be defined as:

$$X_T = [V_e(t)\,\text{Cos}\,\phi]\,\text{Cos}\, W_c t + [V_e(t)\,\text{Sin}\,\phi]\,\text{Sin}\, W_c t \quad (6)$$

Equating the coefficients of like terms from equations (2) and (6), we get:

$$V_e(t)\,\text{Cos}\,\phi = 1 + (L+R)\,\text{Cos}\,\theta \quad (7)$$

$$V_e(t)\,\text{Sin}\,\phi = (L-R)\,\text{Sin}\,\theta \quad (8)$$

Equations (7) and (8) will have pertinence to the description of FIGS. 12–14 hereinafter.

In the past it had been the practice to generate this composite modulated signal by modulating plural carrier signals, and then linearly combining them to generate the composite signal. The result was a low level, composite modulated RF signal. In order for this signal to then be amplified and transmitted with conventional transmitters, it was necessary to separate it into phase and amplitude portions. The RF signal was therefore amplitude limited to provide a fixed level RF signal incorporating the phase information of the composite RF signal, and envelope detected to provide an envelope signal having an amplitude corresponding the envelope of the composite RF signal. A conventional AM transmitter was then utilized to amplify the phase carrying RF signal to appropriate power levels, and to amplitude modulate the resulting signal in accordance with the envelope signal. This past practice therefore required the successive steps of modulation, demodulation, and modulation again.

The present invention avoids this redundant modulation-demodulation-modulation process by directly implementing the mathematical expressions defining the phase and envelope characteristics of the composite modulated signal (in this case equations (4) and (5)).

There is illustrated in FIG. 3 a stereo modulator 20 in accordance with the teachings of the present invention. This stereo modulator includes a matrix circuit 52 which combines the left and right source signals so as to derive signals indicative of the amplitude of the two orthogonal vector components 48 and 50, shown in FIG. 2b. These two signals are then directed to phase and envelope operators 54 and 56 in order to directly derive the phase and envelope information necessary to generate the composite modulated signal. Phase operator 54 determines the phase angle in accordance with equation 5, whereas operator 56 determines the envelope function in accordance with equation 4. Phase modulator 58 responds to the phase signal provided by phase operator 54 in order to modulate the phase of an RF carrier signal in accordance therewith.

The phase and amplitude portions of the composite modulator signal are thus directly derived, independently of one another. This permits the composite modulated signal to be generated with less distortion, since the multiple steps of modulation-demodulation-modulation are no longer necessary.

This modulator also simplifies the inclusion of the time delays which are often necessary to synchronize the phase portion of the composite modulated signal with the amplitude portion. Where earlier designs often required the delay of RF signals, only audio frequency delays need be used in the present invention. Thus, in the embodiment illustrated in FIG. 3, the phase signal provided by phase operator 54 is an audio frequency signal and may be readily delayed in a number of inexpensive ways. In this Figure, a delay circuit 60 is included between phase operator 54 and phase modulator 58 for this purpose. Delay circuit 60 could, for example, be a low-pass, audio bandwidth (20 khz–100 khz cutoff frequency) Bessel filter, with a number of poles selected as a coarse adjustment on time delay, and a variable cutoff frequency as a vernier adjustment on time adjustment. This time delay circuit 60 could also be implemented using a CCD delay line with the clocking frequency of the delay line being selected in accordance with the desired delay. Of course, any selected delay technique could also be made voltage controllable. In this event, a closed loop control system could be provided to monitor the output of the RF modulator 22 and adjust the time delay 60 so as to maximize separation or minimize distortion.

In the event that the time delay in the RF amplifiers of RF modulator 22 is greater than the time delay in the audio modulator of RF modulator 22, a delay 62 could instead be provided in the path of the envelope signal provided by envelope operator 56. This circuit would be constructed and adjusted as described with respect to delay circuit 60.

A low level modulator 64 may also be included if it is desired to provide a low level modulated output for transmission over a wire line, for monitoring purposes, or for any other desired use.

FIG. 4 illustrates the matrix block of FIG. 3 in somewhat greater detail. As can be seen in this Figure, the left and right source signals are directed to an audio matrix circuit comprised of two adders 66 and 68, and an analog inverter 70. Analog adder 66 adds the L and R signals to provide a sum (L+R) signal. Adder 68 operates in conjunction with analog inverter 70 to subtract the R signal from the L signal and thus provide a difference (L−R) signal. These sum and difference signals are respectively attenuated in accordance with fixed attenuation factors of Cos $\theta$ and Sin $\theta$ by signal attenuators 72 and 74. These signal attenuators may comprise simple resistive divider networks. An additional signal adder 76 combines a DC term (+1) with the amplitude adjusted sum signal. The outputs of signal adder 76 and signal attenuator 74 comprise the outputs of the matrix circuit 52, and respectively represent the amplitude functions of the in-phase and quadrature-phase components 48 and 50 of the composite modulated signal (see equation (2)). If desired, a pilot (for example a 20 Hz tone) may also be added to the signal to indicate its stereophonic nature. In FIG. 4, this is indicated by a pilot signal generator 78 which is shown as supplying a pilot signal to adder 68.

These amplitude signals are directed to phase operator 54, which is shown in greater detail in FIG. 5. This phase operator responds to the amplitude functions of the in-phase and quadrature-phase components of the composite modulated signal, and provides an output corresponding to the arctangent of the ratio thereof. This output (note equation (5)) corresponds to the phase of the composite modulated signal. The circuitry in FIG. 5 calculates the arctangent function in accordance with the approximation:

$$\arctan \frac{V_B}{V_A} = 2\left[\frac{(V_B/V_A)^{1.2125}}{1+(V_B/V_A)^{1.2125}}\right] \quad (9)$$

In FIG. 5, this function is implemented through use of a conventional multifunction converter 80, which has a transfer function of:

$$E_o = Y(Z/X)^m \quad (10)$$

Multifunction converters of this type are manufactured by a number of companies. Specifically, either the model 4301, manufactured by Burr-Brown, or the model MF433, manufactured by Intronics, will be suitable for this purpose.

In order to provide the transfer characteristics necessary to implement the function of equation (9), the Y input of multifunction converter 80 is provided by feeding back the output through an operational amplifier circuit 82. This op-amp circuit 82 includes three resistors 84, 86, and 88, in conjunction with a conventional operational amplifier 90. The output signal $E_O$ of multifunction convertor 80 is supplied to the inverting input of operational amplifier 90 through resistor 86. Similarly, a reference signal provided by a reference circuit 92 is also connected to the inverting input of operational amplifier 90 through resistor 88. Feedback is provided by a third resistor 84. All of resistors 84, 86, and 88 have like values. When connected in this fashion, the transfer characteristics of the operational amplifier circuit 82 will have the following form:

$$Y = -E_O + \pi/2 \quad (11)$$

The power factor M of the multifunction convertor is set by scaling the values of two resistors 92 and 94 which are connected to the A, B, and C inputs of multifunction converter 80. In order to provide the required power factor of M=1.2125, resistor 92 will be selected to have a value of 83.33 ohms, whereas resistor 94 will be selected to have a value of 16.67 ohms.

The circuitry which has thus far been described will provide an output on the output line $E_O$ which will correspond to the term on the righthand side of the equality sign in equation (9), and thus to the arctan of the ratio of the two input signals provided to the X and Z inputs thereof. This circuitry will not, however, function properly except in the first quandrant, wherein both the X and Z inputs are positive. Although the signal provided to the Z input to multifunction converter 80 will never fall below zero, the signal provided to the X input of the multifunction converter 80 may have either a positive or negative sign. A comparator circuit 96 is therefore provided to sense the polarity of this signal. If the signal is positive, then the output of comparator 96 will be at a low logic level. If, on the other hand, the signal is negative, then the output of comparator 96 will be at a high logic level. Four analog switches 98, 100, 102, and 104 are provided which are controlled by the output of comparator 96. If the input is positive, then the switches will be in the position shown so that the signal is provided directly to the X input of multifunction converter 80, and so that the output of phase operator 54 is taken directly from the $E_O$ output of multifunction converter 80. In the event that this input is negative, however, then switches 98, 100, 102, and 104 are switched to their alternate positions, wherein the input to multifunction converter 80 is taken through an analog inverter 106, and the output from multifunction converter 80 is taken through another analog inverter 108. This polarity sensing circuit thus functions to fold all input signals into the first quadrant, and to correct the polarity of the output signal in accordance with the actual quadrant in which the input signals lie.

Figure 6:
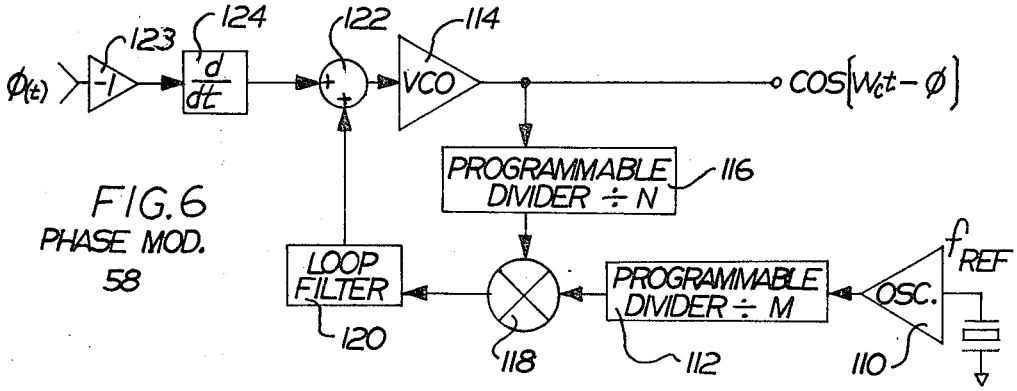
FIG. 6 is a more detailed illustration of the phase modulator block of the stereo modulator of FIG. 3.

There is illustrated in FIG. 6 a more detailed illustration of one form which phase modulator 58 could take. In this Figure, a phase-locked-loop frequency synthesizer is provided, wherein the frequency is adjusted in accordance with the phase signal supplied by phase operator 54. This frequency synthesizer includes a reference frequency source comprising an oscillator 110, divided down by a programmable divider 112. The reference signal, thus generated, is compared by phase detector 118 with the output of a voltage controlled oscillator 114 as divided down by a second programmable divider 116. Phase detector 118 compares the phases of the output of programmable dividers 112 and 116, and provides an output indicative of the phase difference therebetween to a loop filter 120. The output of loop filter 120 is applied to the frequency control input of VCO 114 through an analog adder 122. Also provided to the analog adder 122 is the output of a differentiator circuit 124 which responds to the phase control signal provided by phase operator 54.

The output signal provided by VCO 114 has a center frequency corresponding to $Nf_{ref}/M$, and is locked into this frequency by the phase-locked-loop comprised of phase detector 118 in conjunction with loop filter 120. The phase of the signal, on the other hand, is adjusted in accordance with the phase output provided by phase operator 54, as inverted by an analog inverter 123. Thus, if the phase signal decreases, the output of differentiator circuit 124 will momentarily go positive, producing a momentary increase in the frequency of the signal provided VCO 114. This will advance the phase of the signal provided by VCO 114 by an amount corresponding to the amount by which the phase signal decreased. Similarly, when the phase signal increases, a momentary negative signal will appear at the output of differentiator circuit 124, leading to a momentary decrease in the frequency of oscillation of VCO 114. Phase modulator 58 therefore provides an RF signal whose center frequency remains unchanged, but whose phase is controlled in accordance with the phase signals provided by phase operator 54.

The envelope operator 56 may be implemented in a number of ways. For example, the operator may directly calculate the square root of the sum of the squares of the two inputs. Also, various dedicated integrated circuits may be used for this function, such as the multifunction converter mentioned above. It is presently preferred, however, that envelope operator 56 comprise a single module, such as the vector computing subsystem, model VM101, manufactured by Intronics.

Figure 7:
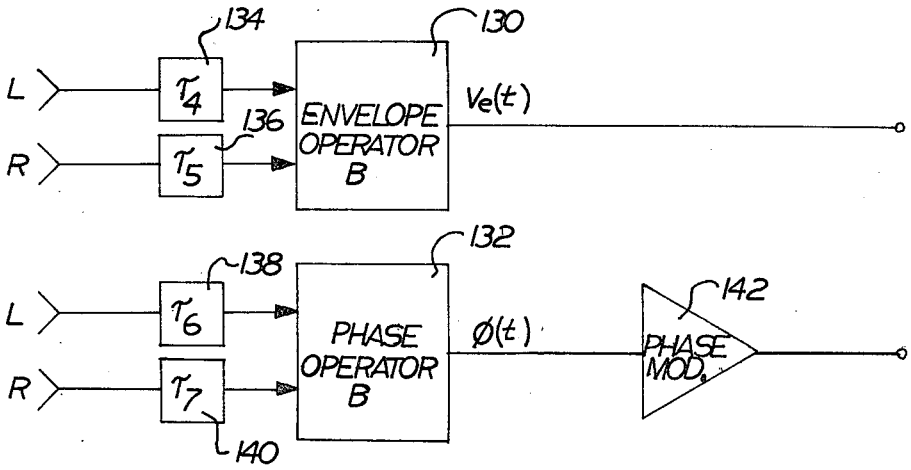
FIG. 7 is a block diagram of another embodiment of a stereo modulator in accordance with the teachings of the present invention.

FIG. 7 illustrates an alternative embodiment of the stereo modulator 20. In this figure, the left and right signals are directly supplied to envelope and phase operators 130 and 132 through appropriate delay circuits 134, 136, 138, and 140. These delay circuits may again be fixed or automatically controlled to synchronize the various portions of the composite modulated signal. The envelope and phase operators will again produce envelope and phase signals having the form mathematically represented by equations (4) and (5). Again, the output of phase operator 132 will be provided to a phase modulator 142, where a carrier signal will be modulated in accordance therewith. Of course, a low level modulator such as modulator 64 of FIG. 3 may also be included in this embodiment, if desired.

Figure 8:
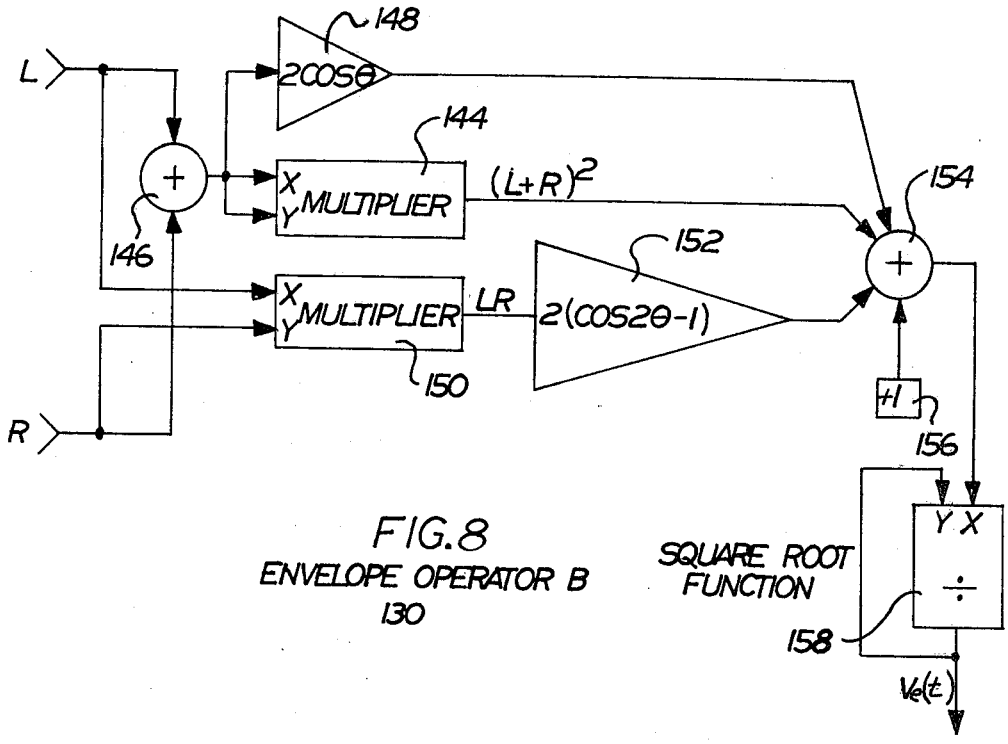
FIG. 8 is a more detailed illustration of the envelope operator block of the stereo modulator of FIG. 7.

The envelope operator 130 of the FIG. 7 stereo modulator is shown in somewhat greater detail in FIG. 8. This circuitry generates the envelope function in accordance with the following equation:

$$V_e(t)=\sqrt{1+(L+R)^2+(L+R)\,(2\,\mathrm{Cos}\,\theta)+2LR(\mathrm{Cos}\,2\theta-1)} \tag{12}$$

It will be noted that this equation is merely an expansion of equation (4), above. The $(L+R)^2$ term is derived by a multiplier 144 having the quantity (L+R) supplied to both inputs thereof via a signal adder circuit 146. The term (L+R) (2 Cos $\theta$) is derived by scaling the gain of the (L+R) output of signal adder circuit 146 through use of a gain circuit 148 having a fixed gain factor of 2 Cos $\theta$. The term 2LR(Cos $2\theta-1$) is generated by multiplier 150 in conjunction with gain circuit 152.

The outputs of circuits 144, 148, and 152 are all combined in a second signal adder circuit 154, together with a DC voltage representing the (+1) term. This DC voltage is provided by circuit 156. The output corresponds to the argument of the squareroot function of equation (12). In order to derive a signal corresponding to the squareroot of this, the output of signal adder circuit 154 is directed to a squareroot circuit 158. This circuit is essentially a conventional analog division circuit having the output connected to one of the inputs.

Figure 9:
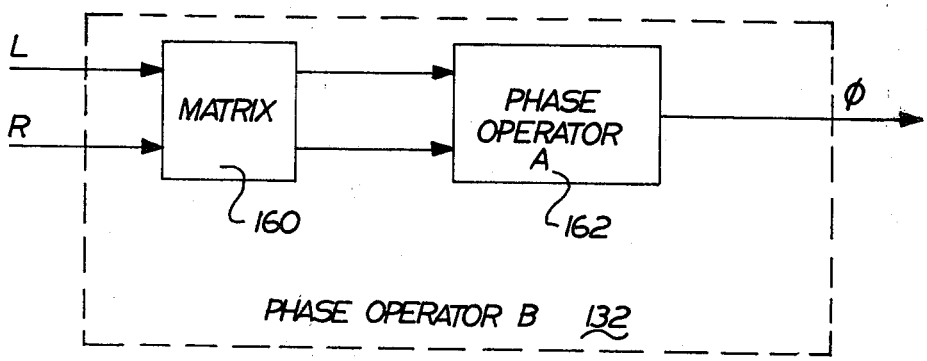
FIG. 9 is a more detailed illustration of the phase operator block of the stereo modulator of FIG. 7.

The phase operator of the FIG. 7 stereo modulator is shown in greater detail in FIG. 9. In this figure, it will be seen that the phase operator comprises a matrix 160, having essentially the same form shown in FIG. 4, and a phase operator 162 having essentially the same form as the phase operator shown in FIG. 5.

In the stereo modulators which have thus far been described, signals are provided which corresponds to the signals described with respect to FIGS. 2A and 2B. The approaches utilized in these modulators, however, may also be used in modulators for deriving different types of composite modulated signals. Thus, one system (proposed by Motorola and usually referred as the C-QUAM system) proposes the use of a composite modulated signal having a somewhat different form. In this proposed system, the phase function of the composite modulated signal is virtually identical to that which would be obtained in a conventional quadrature modulated scheme (in other words, the phase function corresponds essentially with the phase functions set out in equation (5), above, except that $\theta$ is now equal to 45° so that the Sin $\theta$ and Cos $\theta$ terms are equalized). The envelope, however, is generated separately and comprises only the (L+R) information.

Thus, for this proposed system, the phase and envelope functions may be defined as:

$$\phi(t) = \arctan\frac{(L-R)}{1+(L+R)} \tag{13}$$

$$V_e(t)=1+(L+R) \tag{14}$$

Figure 10:
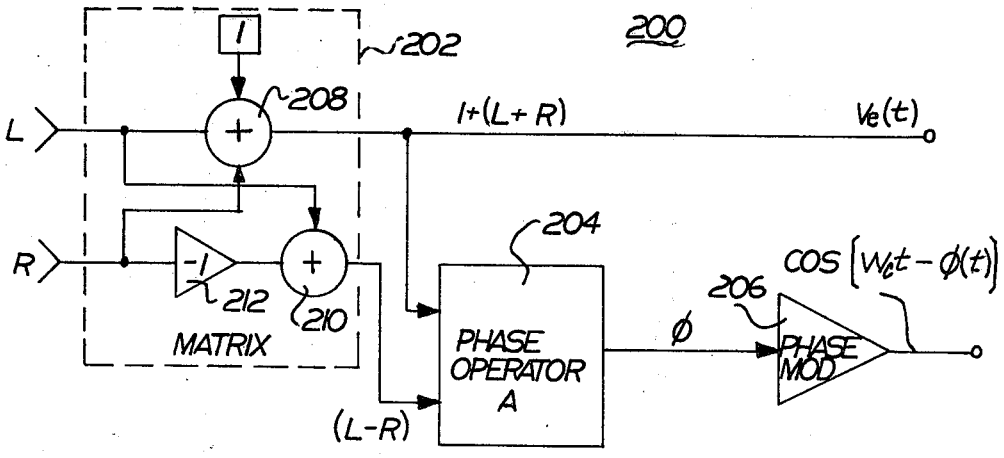
FIG. 10 is a block diagram of another stereo modulator in accordance with the teachings of the present invention, for providing a composite modulated signal having a different form.
Figure 11:
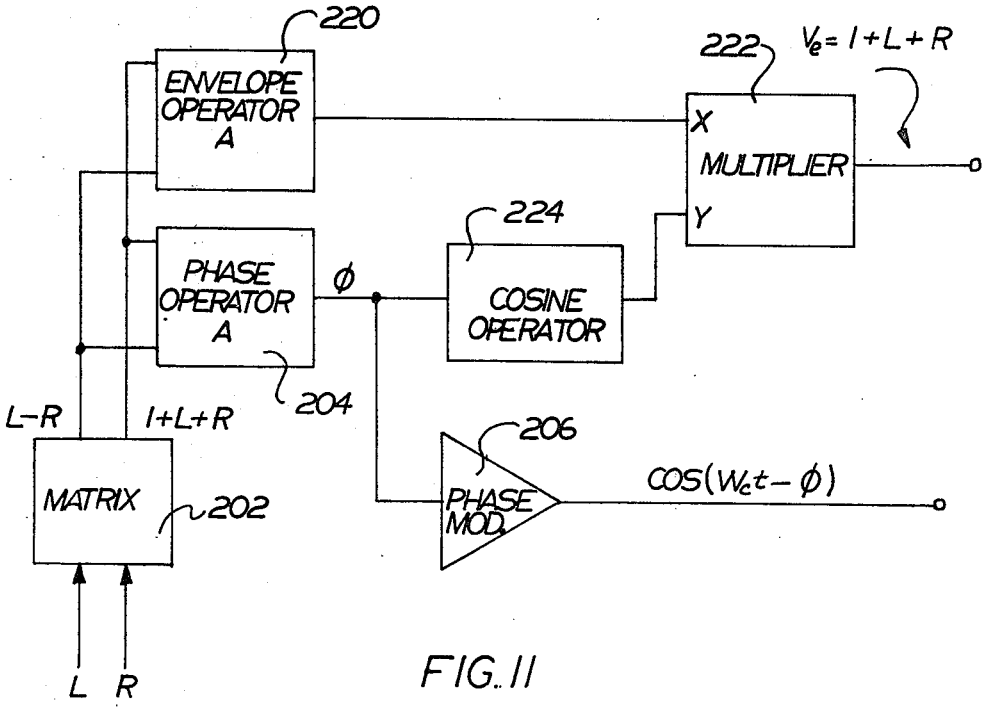
FIG. 11 is a block diagram of yet another stereo modulator in accordance with the teachings of the present invention, for providing a composite modulated signal having the same form as that provided by the modulator in FIG. 10.

The embodiments illustrated in FIGS. 10 and 11 represents two implementations of modulators for generating composite modulated signals having the form defined in these equations, in accordance with the teachings of the present invention.

In FIG. 10, a stereo modulator 200 is shown including a matrix circuit 202, a phase operator 204, and a phase modulator 206. Matrix circuit 202 includes a signal adder circuit 208 which adds the left and right signals together with a DC term to provide an output corresponding to the quantity $(1+L+R)$. A second signal adder circuit 210 adds the L signal with the R signal through an analog inverter circuit 212 to provide at its output a signal corresponding to the quantity (L−R). These two signals are directed to the phase operator 204, which has essentially the same form as illustrated in FIG. 5 with respect to phase operator 54. Thus, phase operator 204 provides at its output a signal having the form defined by equation (13), above. The differences between the output signals of phase operators 54 (FIG. 3) and 204 (FIG. 10) result from the different signals provided to the inputs thereof by matrix circuits 52 and 202 respectively.

The output of adder circuit 208 corresponds exactly to the desired form of the envelope function, and thus this signal is directly supplied at the output of the stereo modulator as the envelope function.

The embodiment of FIG. 11 generates the phase signal in essentially the same manner as shown and described in FIG. 10. This embodiment therefore also includes a matrix circuit 202, a phase operator 204, and a phase modulator 206. The envelope function, however, is derived in a different manner. It will be recognized that the envelope function may equivalently be represented as:

$$V_e(t)=\sqrt{(1+L+R)^2+(L-R)^2 \cos \phi} \qquad (15)$$

This equation essentially states that the envelope function (equation (14)) represents one of two orthogonal components of a vector whose magnitude is defined by the squareroot term of equation 15. The magnitude of this component is equal to the magnitude of the vector, times the cosine of the included angle $\phi$.

In order to implement equation (15), the embodiment of FIG. 11 includes an envelope operator 220 which, as described previously, may comprise any of a number of readily available vector computing hybrid circuits. The output of envelope operator 220 will be a signal corresponding to the magnitude of a vector of which the (L−R) and $(1+L+R)$ vectors are orthogonal components. A multiplier 222 multiplies this signal by a signal provided by a cosine operator 224. The resulting envelope signal provided at the output of multiplier 222 has the form equivalently defined in equations (14) and (15), above.

Figure 12:
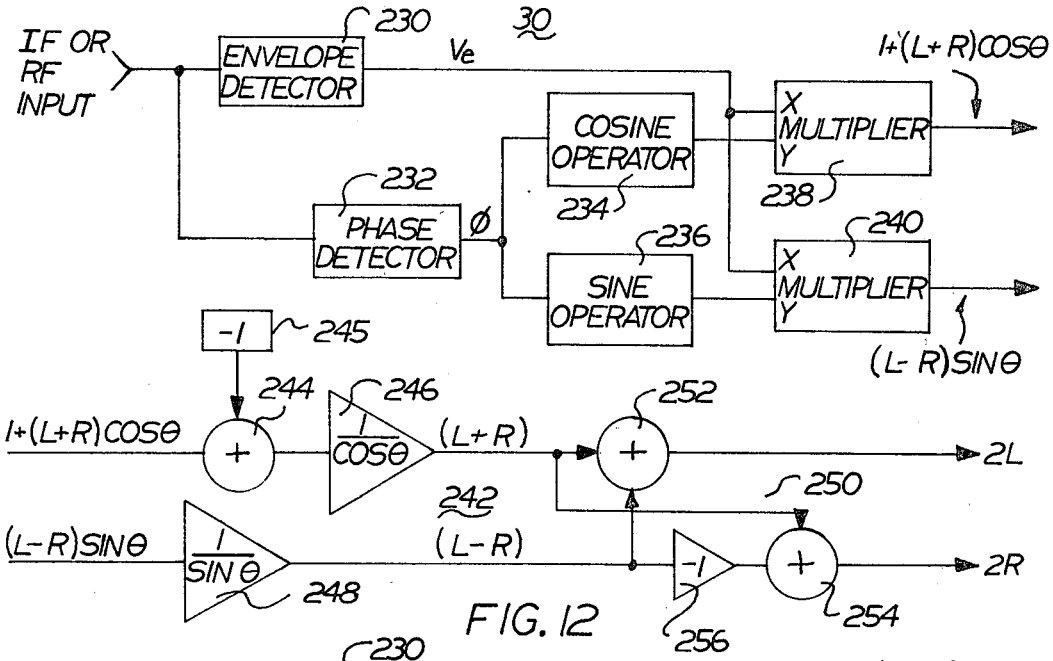
FIG. 12 is a block diagram of a demodulator in accordance with the teachings of the present invention.
Figure 13:
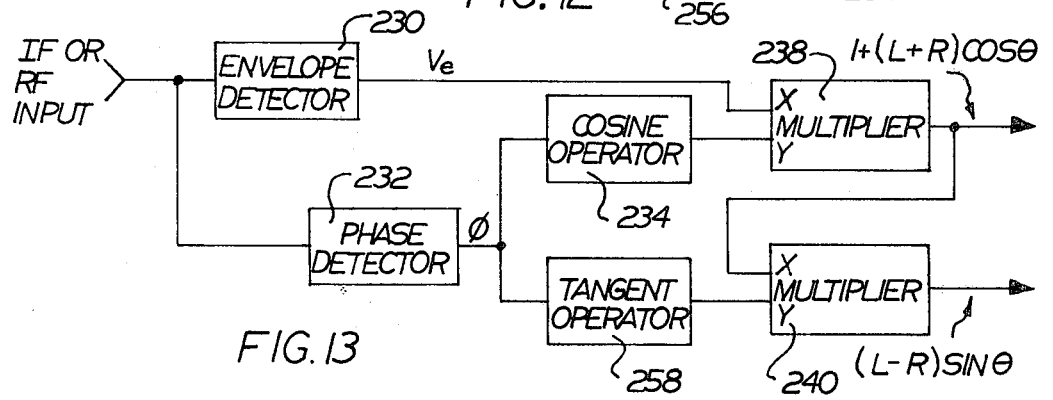
FIG. 13 is a block diagram of another embodiment of a stereo demodulator in accordance with the teachings of the present invention.
Figure 14:
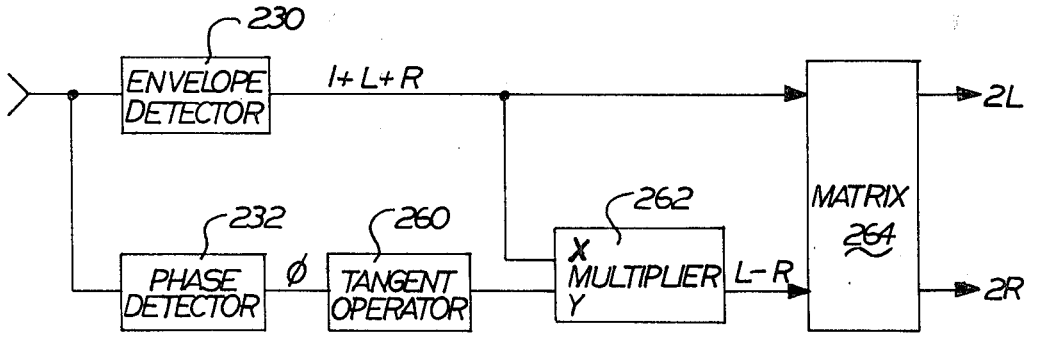
FIG. 14 is a block diagram of a demodulator in accordance with the teachings of the present invention, for demodulating a composite modulated signal having a different form.

FIGS. 12, 13 and 14 represents three embodiments of stereo demodulator 30 (FIG. 1) which directly derive the left and right signals from the modulated RF signal by implementing the equations defining the composite modulated signal. FIGS. 12 and 13 illustrate stereo demodulators for recovering the left and right signals from composite modulated signals as defined by equations (1)-(6). FIG. 14, on the other hand, illustrates a stereo demodulator for recovering the left and right signals from a composite modulated signals as defined by equations (13) and (14).

The stereo demodulator shown in FIG. 12 demodulates the composite modulated signal by implementing equations (7) and (8), above. Thus, this demodulator recovers the envelope and phase functions from the composite modulated signal, and then determines the magnitude of the two orthogonal components thereof (vectors 46 and 48, as seen in FIG. 2B) by multiplying the envelope signal by the cosine and sine of the phase signal. To this end, the stereo demodulator 30 includes an envelope detector 230 and a phase detector 232, both of which may take any conventional form. Phase detector 232 may, for example, be a conventional phase detector including a limiter, frequency discriminator and an integrator. The input signal provided to detectors 230 and 232 will preferably be derived from an IF front-end (such as front-end 28 of FIG. 1), but may instead be the RF input signal, directly supplied thereto via an RF amplifier stage.

The output of phase detecter 232 is supplied to two trigonometric operators 234, and 236. These trignometric operators, which may be implemented in a conventional fashion with multifunction converters, respectively provide outputs corresponding to the cosine and sine of the phase signal provided by phase detector 232. Analog multipliers 238 and 240 multiply the output of the trignometric operators by the envelope function so as to thereby derive signals corresponding respectively to the magnitude of the in-phase (equation (7)) and quadrature-phase (equation (8)) components of the composite modulated signal.

The outputs of multipliers 238 and 240 are then directed to a matrix circuit 242 which processes the signals so as to recover the left and right source signals therefrom. The output of multiplier 238 is applied to an adder circuit 244 which subtracts a DC level, provided by a reference circuit 245, therefrom so as to remove the DC level corresponding to the (1+) term of equation (7) and thus provide an output corresponding to (L+R) Cos $\theta$. The DC level could also be removed, of course, by AC coupling the output of multiplier 238 to the matrix circuit 242. Since the sum signal provided at the output of multiplier 240 is weighted in accordance with a different factor than the difference signal provided at the output of adder circuit 244, signal gain circuits 246 and 248 must be provided to readjust the relative amplitudes of the two signals. Signal gain circuits 246 and 248 respectively provide fixed gain factors of (1/Cos $\theta$) and (1/Sin $\theta$), so that their outputs correspond closely to the sum (L+R) and difference (L−R) of the two source signals. A conventional audio matrix circuit 250 addes and substracts these two signals in order to derive the left and right source signals therefrom. Audio matrix 250 includes a signal adder circuit 252 which addes the sum and difference signals to derive the left source signal therefrom, and a signal adder 254 which operates in conjunction with an analog inverter circuit 256 so as to subtract the sum and difference signals, thereby recovering the right source signal therefrom.

FIG. 13 provides an alternative embodiment of a stereo demodulator for demodulating composite modulated signals of the same form as demodulated by the embodiment of FIG. 12. This demodulator also includes an envelope detector 230, a phase detector 232, a cosine operator 234, and a multiplier 238 in order to derive the weighted sum signal from the composite modulated signal. The weighted difference signal, however, is derived in a somewhat different manner. Thus, multiplier 240 in this instance multiplies the output of multiplier 238 by a signal provided by a trigonometric operator 258. Trigonometric operator 258 provides an output signal corresponding to the tangent of the input signal, and again may be implemented with a multifunction convertor in a conventional fashion. The input signal to trigonometric operator 258 is derived from phase detector 232. The output of multiplier 240 is therefore:

$$V_o=[1+(L+R)\ \mathrm{Cos}\ \theta]\ \tan\phi \quad (16)$$

But since:

$$\tan\phi=(L-R)\ \mathrm{Sin}\ \theta/[1+(L+R)\ \mathrm{Cos}\ \theta] \quad (17)$$

It follows that:

$$V_o=(L-R)\ \mathrm{Sin}\ \theta \quad (18)$$

The outputs of multipliers 238 and 240 will be supplied to a matrix circuit such as matrix circuit 242, shown in FIG. 12.

The stereo demodulator shown in FIG. 14 recovers the left and right source signals from a composite modulated signal as defined by equations (13) and (14). In this system:

$$V_e(t)=1+L+R \quad (19)$$

$$\text{ti } V_e(t)\ \tan\phi\ (t)=L-R \quad (20)$$

The demodulator illustrated in FIG. 14 includes an envelope detector 230 and a phase detector 232, as in the previous embodiments. In view of equation (19), it should be noted that the output of envelope detector 230 represents the sum of the left and right source signals (plus a DC term), without further processing. In order to derive the difference signal (see equation (20), above) the output of phase detector 232 is operated upon by a trigonometric operator 260, which may take the same form as tangent operator 258 of FIG. 13. The output of this trigonometric operator thus corresponds to the tangent of the phase. The output of operator 260 is multiplied by the envelope signal via a multiplier 262. From equation (20) it follows that the output of multiplier 262 corresponds to the difference (L−R) signal. The sum and difference signals are then directed to a matrix circuit 264 wherein they are processed to recover the left and right source signals therefrom. The matrix circuit 264 will be generally similar to the matrix circuit 242 of the embodiment shown in FIG. 12, with the exception that the gain circuits 246 and 248 will have equal values, and are thus unnecessary.

Many variations of the described embodiments are possible, and many circuits may be used to implement the various blocks of the described embodiments, other than those specifically mentioned. Thus, for example, the various trigonometric operators described herein could be implemented through use of circuits for synthesizing the series expansions of the trigonometric terms, rather than with multifunction convertors in the suggested manner. As another example, many other circuits may be used for deriving the arctangent function, other than the circuit shown in FIG. 5. Thus, the arctangent may be approximated as a sum of one or more hyperbolic tangents, and may, for instance, be approximated as:

$$\arctan\ [V_B/V_A]=(\pi/2)\ \tanh\ [V_B/1.8\ V_A] \quad (20)$$

This may be implemented by first deriving the ratio signal $V_B/1.8\ V_A$) in a conventional analog divider, and then deriving the hyperbolic tangent of this signal through use of a hyperbolic tangent operator. A differential transister pair has a hyperbolic tangent transfer function and could thus serve as this operator.

Of course, modulators and demodulators in accordance with the present invention could also be implemented through use of digital processing techniques. Thus, a microprocessor controlled system could be provided which would convert the audio signals to digital, process the resulting digital signals in manner analogous to the disclosed analog processing, and then reconvert the resulting processed digital signals back into analog form.

Therefore, although the invention has been described with respect to a preferred embodiment, it will be appreciated that various rearrangements and alterations of parts may be made without departing from the spirit and scope of the present invention, as defined in the following claims.

What is claimed is:

1. Apparatus for asynchronously demodulating a modulated signal having at least two common frequency, differently phased components, each of which components is modulated by a corresponding modulating signal, comprising:

envelope detector means responsive to said modulated signal to provide an envelope signal corresponding generally to the envelope of said modulated signal;

phase detector means responsive to said modulated signal to provide a phase signal corresponding generally to the phase of said modulated signal;

sinusoidal operator means responsive to said phase signal for providing an output signal which is related to said phase signal in accordance with a selected sinusoidal relationship; and combiner means for combining said output signal and said envelope signal so as to thereby provide a demodulated output signal.

2. Apparatus as set forth in claim 1, wherein said modulated signal also includes a DC carrier component and wherein said sinusoidal operator means includes sine operator means for providing a sine output corresponding generally to the sine of the phase signal, and cosine operator means for providing a cosine output corresponding generally to the cosine of the phase signal and further wherein said combiner means comprises means for combining said cosine signal and said envelope signal so as to provide a first resulting signal corresponding generally to the signal modulating the component of said modulated signal which is in-phase with said carrier component, and for combining said sine signal and said envelope signal so as to provide a second resulting signal corresponding generally to the component of said modulated signal which is in phase quadrature with said carrier component.

3. Apparatus as set forth in claim 2, and further comprising processing means for processing said first and second resulting signals so as to recover first and second demodulated output signals therefrom.

4. Apparatus as set forth in claim 3, wherein said modulated signal includes a carrier component and two modulated components having the same frequency as said carrier component, but phase displaced at substantially equal phase angles on either side of said carrier component, said modulated components each being modulated in accordance with a corresponding source signal, and wherein said processing means comprises means for adjusting the relative amplitudes of said first and second resulting signals as a function of said phase angle to provide amplitude adjusted signals, and means for adding said amplitude adjusted signals to one another in order to derive one of said two source signals, and for subtracting said amplitude adjusted signals from one another in order to derive the other of said source signals.

5. Apparatus as set forth in claim 1, wherein said sinusoidal operator means comprises cosine operator means for providing a cosine output corresponding generally to the cosine of said phase signal, and wherein said apparatus further comprises tangent operator means for providing an output corresponding generally to the tangent of said phase signal, and second combiner means for combining said tangent output and said demodulated output to provide a second demodulated output.

6. Apparatus for recovering first and second source signals from a composite modulated signal including a carrier component and two phase components phased at substantially equal angles on either side of said carrier component, said phase components each being modulated by a corresponding one of said source signals, comprising envelope detector means responsive to said composite modulated signal for providing an envelope signal having an amplitude which varies in accordance with the envelope of said composite modulated signal;

phase detector means responsive to said composite modulated signal for providing a phase signal having an amplitude which varies in accordance with the phase of said composite modulated signal;

trigonometric operator means responsive to said phase signal to provide a cosine signal having an amplitude which varies in accordance with the cosine of said phase signal, and a sine signal having an amplitude which varies in accordance with the sine of said phase signal;

first multiplier means for multiplying said envelope signal by said cosine signal to provide a first product signal;

second multiplier means for multiplying said envelope signal by said sine signal to provide a second product signal;

amplitude adjustment means for adjusting the amplitudes of said first and second product signals in accordance with the phase angle between said two phase components of said composite modulated signal to respectively provide first and second amplitude adjusted product signals; and, means for adding said amplitude adjusted product signals to one another to thereby provide one of said first and second source signals, and for subtracting said amplitude adjusted product signals one from the other to thereby provide the other of said first and second source signals.

7. Apparatus for generating a composite modulated signal including a carrier component and two common frequency, differently phased components phased at equal and opposite angles on either side of said carrier component, each of said components being amplitude modulated by a corresponding source signal, comprising:

means for providing said first and second source signals;

means responsive to said first and second signals for deriving an envelope signal having an amplitude which varies as the envelope of said composite modulated signal is to vary, and for deriving a phase signal having an amplitude which varies as the phase of said composite modulated signal is to vary, with said envelope and phase signals being derived directly from said first and second source signals without intermediately modulating an RF signal therewith;

means responsive to said phase signal for providing a carrier signal whose phase varies in accordance with the amplitude of said phase signal; and modulating means for modulating the amplitude of said carrier signal in accordance with the amplitude of said envelope signal so as to thereby provide said composite modulated signal.

8. Apparatus as set forth in claim 7, wherein said means responsive to said first and second source signals comprises matrixing means for combining said source signals so as to produce first and second component signals indicative of the amplitudes of two orthogonal components of said composite modulated signal, envelope means for deriving a signal having an amplitude indicative of the amplitude of the vector sum of said orthogonal components, and phase means for deriving a phase signal having an amplitude indicative of the phase angle of said vector sum with respect to one of said orthogonal components.

9. Apparatus as set forth in claim 8, wherein said matrixing means comprises means for providing a first component signal which varies in accordance with the sum of said first and second source signals, and for providing a second component signal which varies in accordance with the difference between said first and second source signals.

10. Apparatus as set forth in claim 9, wherein said phase means comprises means for providing a phase signal which varies as the arctangent of the ratio of said first and second component signals.

11. Apparatus as set forth in claim 7, wherein said means responsive to said first and second source signals comprises envelope means responsive to said first and second source signals for providing said envelope signal, and phase means responsive to said first and second source signals to provide said phase signal.

12. Apparatus as set forth in claim 7, wherein said means responsive to said first and second source signals comprises matrixing means for providing a sum signal which varies in accordance with the sum of said first and second source signals, and for providing a difference signal which varies in accordance with the difference between said first and second source signals, and means for providing a phase signal which varies as the arctangent of the ratio of said sum and difference signals.

13. Apparatus as set forth in claim 7, and further including means for delaying one of said envelope and phase signals so as to substantially synchronize the phase and amplitude portions of said composite modulated signal.

14. Apparatus for providing an RF signal whose phase is modulated in accordance with the phase of the vector sum of first and second vector components, comprising:

first means for providing first and second signals which respectively define the amplitudes of said first and second vector components;

second means responsive to said first and second signals for providing third and fourth signals each of which defines the amplitude of a corresponding one of two orthogonal vectors whose vector sum is the same as the vector sum of said first and second vector components;

third means responsive to said third and fourth signals for deriving a phase signal indicative of the phase angle between said vector sum and one of said third and fourth signals; and, phase modulator means for modulating the phase of an RF signal in accordance with said phase signal.

15. Apparatus as set forth in claim 1, wherein said combiner means comprises multiplier means for multiplicatively combining said output signal and said envelope signal to thereby provide said demodulated output signal.

16. Apparatus as set forth in claim 14, wherein said second means comprises matrixing means for providing a third signal which varies in accordance with the sum of said first and second signals, and for providing a fourth signal which varies in accordance with the difference between said first and second signals, and said third means comprises means for providing a phase signal which varies as the arctangent of the ratio of said third and fourth signals.

17. Apparatus as set forth in claim 14, and further comprising means for amplitude modulating said RF signal in accordance with said third signal.

18. Apparatus as set forth in claim 14, and further comprising means for amplitude modulating said RF signal in accordance with the squareroot of the sum of the squares of said third and fourth signals.

19. Apparatus for demodulating the quadrature-phase component of an amplitude and phase varying input signal comprising:

means responsive to said input signal for providing an envelope signal which varies as the envelope of said input signal;

means responsive to said input signal for providing a phase signal which varies as the phase of said input signal;

means responsive to said phase signal for providing a sine signal which varies as the sine of said phase signal, and means for multiplying said sine signal by said envelope signal to thus provide a product signal corresponding to said demodulated quadrature-phase component.

20. Apparatus for demodulating the in-phase component of an amplitude and phase varying input signal comprising:

means responsive to said input signal for providing an envelope signal which varies as the envelope of said input signal;

means responsive to said input signal for providing a phase signal which varies as the phase of said input signal;

means responsive to said phase signal for providing a cosine signal which varies as the cosine of said phase signal, and means for multiplying said cosine signal by said envelope signal to thus provide a product signal corresponding to said demodulated in-phase component.

21. An AM stereo modulator for generating a composite modulated signal including a carrier component and two common frequency, differently phased components phased at equal and opposite angles $\theta$ on either side of said carrier component, each of said components being amplitude modulated by a corresponding source signal, comprising:

means for providing said first and second source signals X1 and X2;

means responsive to said first and second signals for deriving an envelope signal having an amplitude which varies as $[1+(X1+X2)\ \mathrm{Cos}\ \theta]^2+[(X1-X2)\ \mathrm{Sin}\ \theta]^2$ and for deriving a phase signal having an amplitude which varies as $\mathrm{arctan}\ [(X1-X2)\ \mathrm{Sin}\ \theta/(1+X1+X2)\ \mathrm{Cos}\ \theta]$ with said envelope and phase signals being derived directly from said first and second source signals without intermediately modulating an RF signal therewith;

means responsive to said phase signal for providing a carrier signal whose phase varies in accordance with the amplitude of said phase signal; and modulating means for modulating the amplitude of said carrier signal in accordance with the amplitude of said envelope signal so as to thereby provide said composite modulated signal.

22. An AM stereo modulator as set forth in claim 21 wherein said means for providing said first and second source signals X1 and X2 comprises means for providing L and R stereo signals each serving as a respective one of said first and second source signals X1 and X2.

* * * * *